US008387538B2

(12) United States Patent
Elder

(10) Patent No.: US 8,387,538 B2
(45) Date of Patent: Mar. 5, 2013

(54) PROJECTILE HAVING CASING THAT INCLUDES MULTIPLE FLACHETTES

(75) Inventor: Steven J. Elder, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 109 days.

(21) Appl. No.: 12/897,901

(22) Filed: Oct. 5, 2010

(65) Prior Publication Data

US 2012/0079957 A1 Apr. 5, 2012

(51) Int. Cl.
*F42B 12/02* (2006.01)

(52) U.S. Cl. ..... 102/477; 102/703; 102/357; 102/489; 102/389; 102/393; 102/378

(58) Field of Classification Search ..... 102/703, 102/489, 357, 477, 393, 378, 389, 491
See application file for complete search history.

(56) References Cited

U.S. PATENT DOCUMENTS 3,412,681 A * 11/1968 Schirneker ..... 102/438
3,956,990 A * 5/1976 Rowe ..... 102/494
4,459,915 A 7/1984 Lynch
H203 H 2/1987 Thomas et al.
4,770,101 A * 9/1988 Robertson et al. ..... 102/489
4,922,826 A 5/1990 Busch et al.
6,276,277 B1 8/2001 Schmacker
6,647,889 B1 11/2003 Biserod
6,766,746 B2 * 7/2004 Spivak et al. ..... 102/489
7,231,876 B2 6/2007 Kellner
7,261,039 B1 8/2007 Bittle et al.
7,261,040 B2 8/2007 Hunn et al.
7,770,521 B2 * 8/2010 Williams et al. ..... 102/364

* cited by examiner

*Primary Examiner* — Daniel J Troy
(74) *Attorney, Agent, or Firm* — Schwegman Lundberg & Woessner, P.A.

(57) ABSTRACT

Some embodiments pertain to a projectile that includes a propellant and a casing that encloses the propellant such that the casing acts as a reaction chamber during flight of the projectile. The casing includes a plurality of flechettes. When the projectile strikes (or is near) a target, a large internal sheer pressure forms within the casing. This sheer pressure causes the flechettes to sheer apart at the thinnest sections of the casing. Once the thin sections of the casing are sheered apart, the flechettes will be unconstrained such that the flechettes take individual flight paths.

12 Claims, 10 Drawing Sheets

PROJECTILE HAVING CASING THAT INCLUDES MULTIPLE FLACHETTES

TECHNICAL FIELD

Embodiments pertain to a projectile, and more particularly to a projectile having a casing that includes multiple flechettes.

BACKGROUND

The impact energy that any moving projectile delivers to a target is determined by the mass of the projectile and velocity of the projectile:

$$KE = \frac{1}{2}MV^2 \quad (1)$$

Maximizing the impact energy of a projectile while minimizing the cost of producing the projectile are some of the primary factors in designing projectiles. Some types of existing projectiles commonly combine a high output rocket motor and a separate kinetic penetrator warhead.

One of the drawbacks with combining a warhead and motor in a single projectile is that the projectile is typically relatively heavy thereby limiting the speed and/or range of the projectile. In addition, the rocket casing material in a conventional projectile typically does not do as much damage as desired upon fragmentation and impact with a target.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, projectile refers to missiles, interceptors, guided projectiles, unguided projectiles and sub-munitions.

Figure 1:
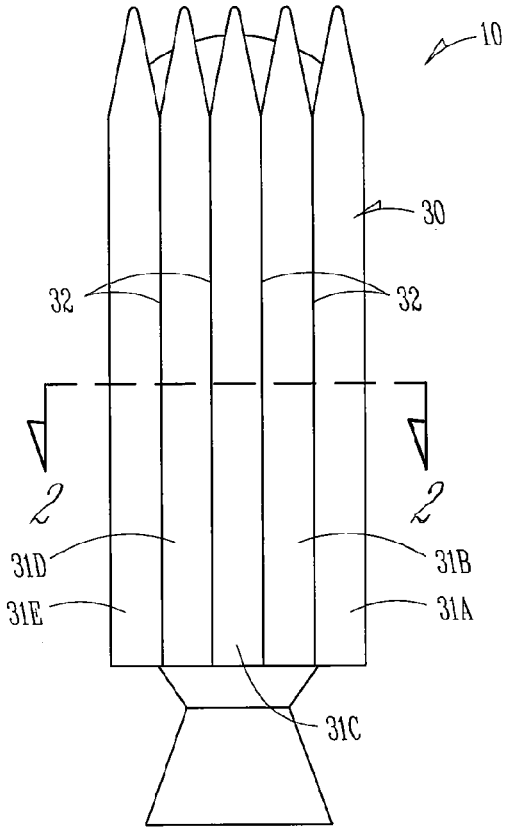
FIG. 1 is a side view of an example projectile.
Figure 2:
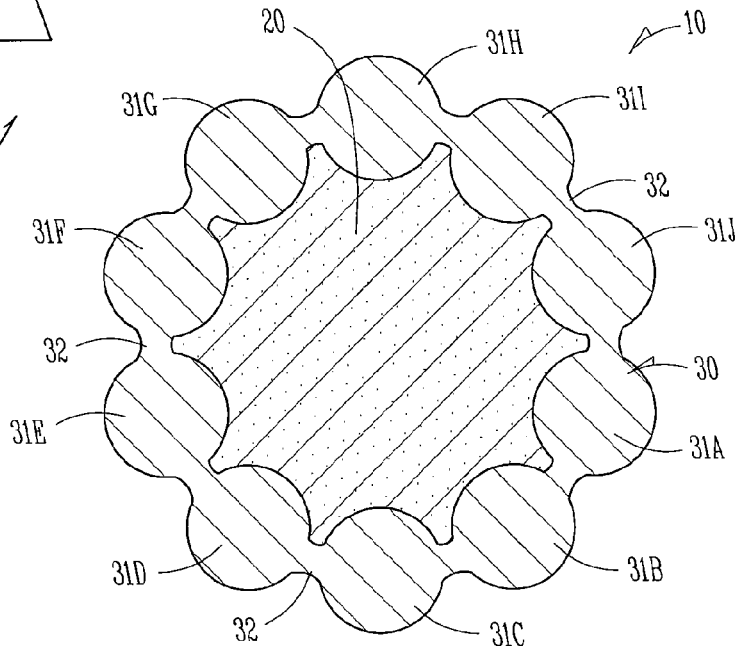
FIG. 2 is a section view of the projectile shown in FIG. 1 taken along line 2-2 in FIG. 1.

FIGS. 1-2 illustrate an example projectile 10. In the example embodiment that is illustrated in FIGS. 1-2, the projectile 10 is a missile. The projectile 10 includes a propellant 20 (shown in FIG. 2 only) and a casing 30 that encloses the propellant 20 such that the casing 30 acts a reaction chamber during burn of the projectile 10. The casing 30 includes a plurality of flechettes 31A-J.

When the projectile 10 strikes (or is near) a target, a large internal sheer pressure forms within the casing 30. This sheer pressure causes the flechettes 31A-J to sheer apart at the thin sections 32 of the casing 30. Once the thin sections 32 of the casing 30 are sheered apart, the flechettes 31A-J will be unconstrained such that the flechettes 31A-J take individual flight paths (see, e.g., unconstrained flechettes 31A-J in FIGS. 4 and 8).

The propellant 20 may be a solid, liquid, gel or any combination thereof. The type of propellant 20 that will be used in the projectile 10 will depend in part on the application where the projectile 10 is to be used (among other factors).

The flechettes 31A-J that form the casing 30 of the projectile 10 each have a cross-section that is designed to serve as a penetrator rod. The thickness, lateral and radial strengths of the flechettes 31A-J may provide an overdesign for the casing 30.

This overdesign of the flechettes 31A-J may impart an increased measure of safety as the propellant 20 burns during flight of the projectile 10. In addition, the overdesign may reduce the effect of any flaws in the casing 30 that could be created during construction of casing 30. Reducing the potential effects of any flaws in the casing 30 may allow for reduced expense in quality control and decrease the risk associated with mishandling the projectile 10.

In some embodiments, the flechettes 31A-J form a sidewall of the casing 30. In the example embodiments that are illustrated in FIGS. 1-8, the flechettes 31A-J extend along the entire sidewall of the casing 30.

The use of flechettes 31A-J may provide an advantage when attacking armored targets that include large or dispersed multiple targets behind the armored barrier. As an example, the flechettes 31A-J may enhance impact with an armored ship when the projectile 10 is directed at the ship.

In the illustrated example embodiments, the longitudinal axis of each flechette 31A-J is parallel to every other flechette 31A-J. In addition, the longitudinal axis of each flechette 31A-J is parallel to a flight axis of the projectile 10.

As discussed above, forming the sidewalls with flechettes 31A-J can enhance the sidewall strength such that the projectile 10 may operate with a higher internal pressure. When the projectile 10 is operated with higher internal pressure, the overall output thrust of the projectile 10 may increase proportionately.

Figure 3:
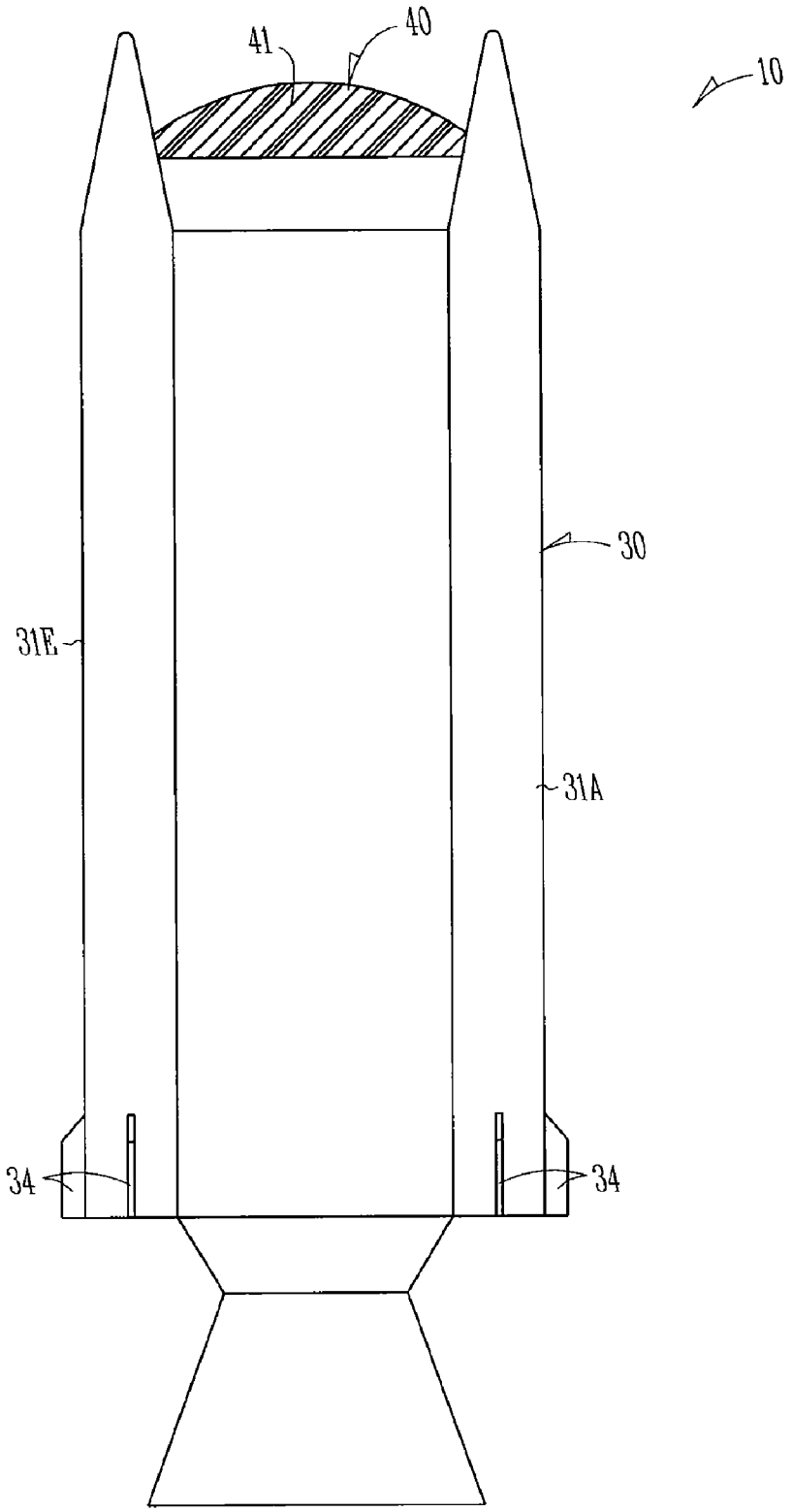
FIG. 3 is a schematic side partial section view of another example projectile.

FIG. 3 illustrates an example embodiment where the projectile 10 further includes a dome 40 at a forward end of the projectile 10. In the illustrated example embodiment, the projectile 10 further includes an explosive 41 that forms the dome 40 such that the explosive 41 separates the flechettes 31A-J upon detonation of the explosive 41. It should be noted that in other embodiments the explosive 41 may be within the dome 40.

Figure 4:
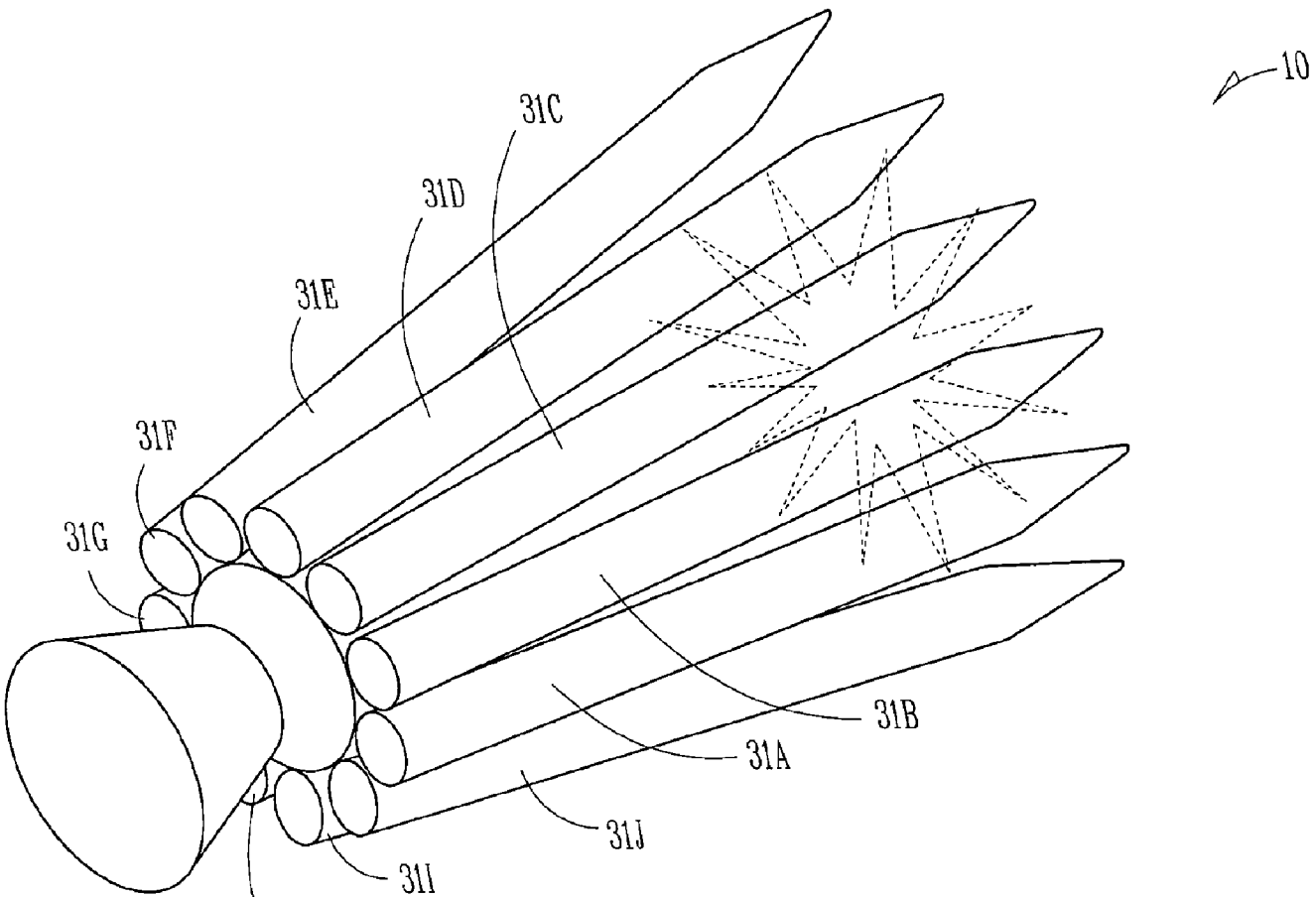
FIG. 4 illustrates the projectile of FIG. 3 just after the ordinance in the projectile has exploded.
Figure 5:
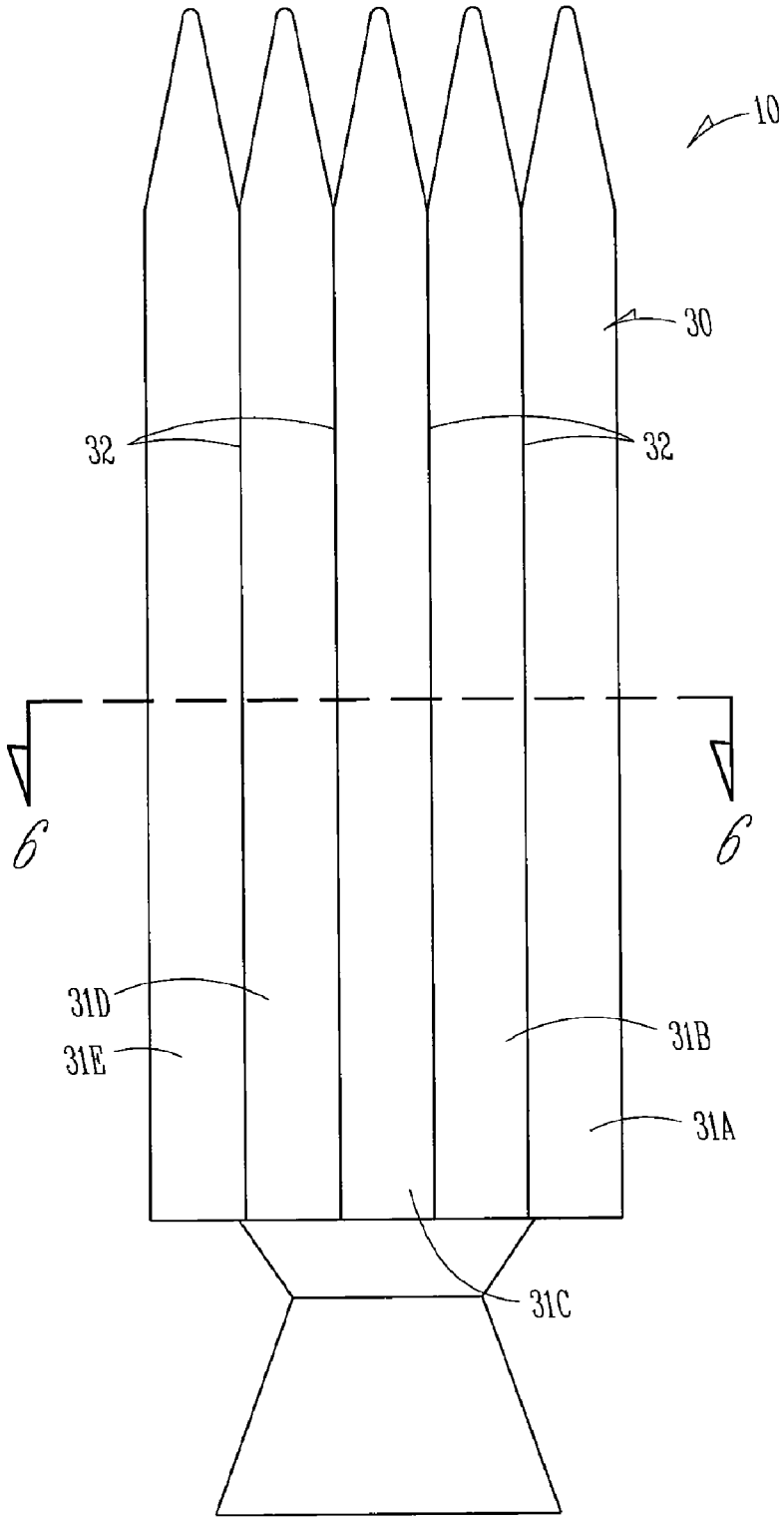
FIG. 5 is a schematic side section view of yet another example projectile.
Figure 6:
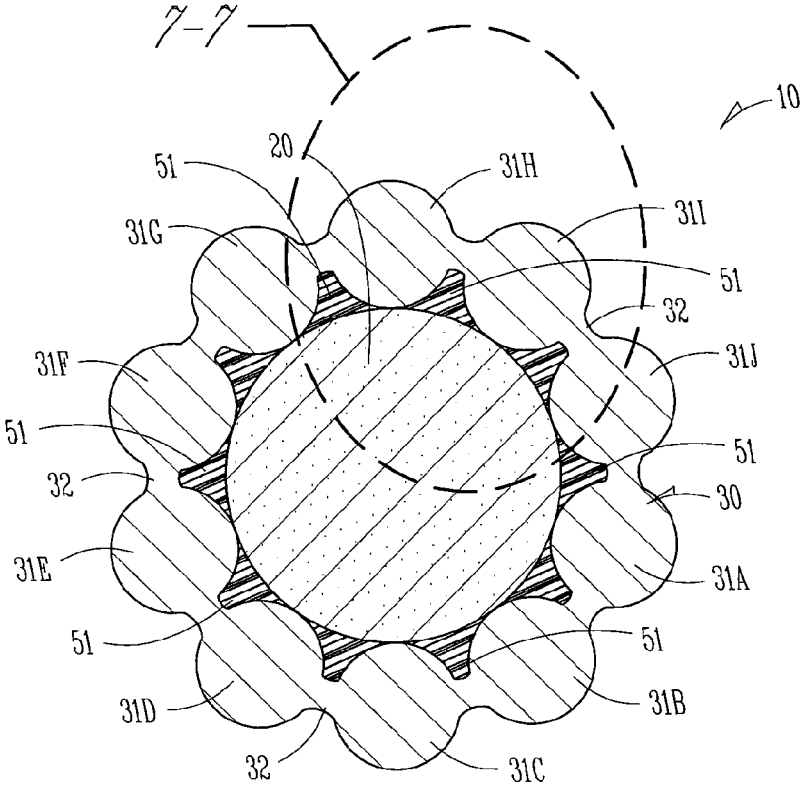
FIG. 6 is a section view of the projectile shown in FIG. 5 taken along line 6-6 in FIG. 5.
Figure 7:
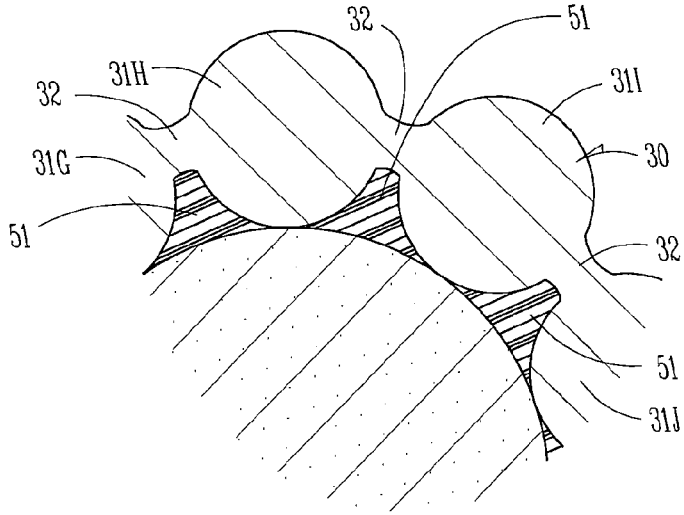
FIG. 7 is an enlarged section view of the projectile shown in FIGS. 5-6 taken from the portion 7-7 in FIG. 6.

FIG. 4 shows how the flechettes 31A-J may disperse into a conical arrangement after detonation of the explosive 41. This dispersion of the flechettes 31A-J may cost effectively (i) increase the impact energy that can be generated by the projectile 10; and/or (ii) increase the size of the kill zone impacted by the projectile 10.

FIGS. 5-8 illustrate an example embodiment where the projectile 10 further includes an explosive 51 (see FIGS. 6 and 7) located between the flechettes 31A-J (i.e., against the thin sections 32 of the casing 30) such that the explosive 51 separates the flechettes 31A-J upon detonation of the explosive 51. It should be noted that the explosive 51 may be between the flechettes 31A-J along the entire length of the flechettes 31A-J, or along one or more specific portions of the flechettes 31A-J.

Figure 8:
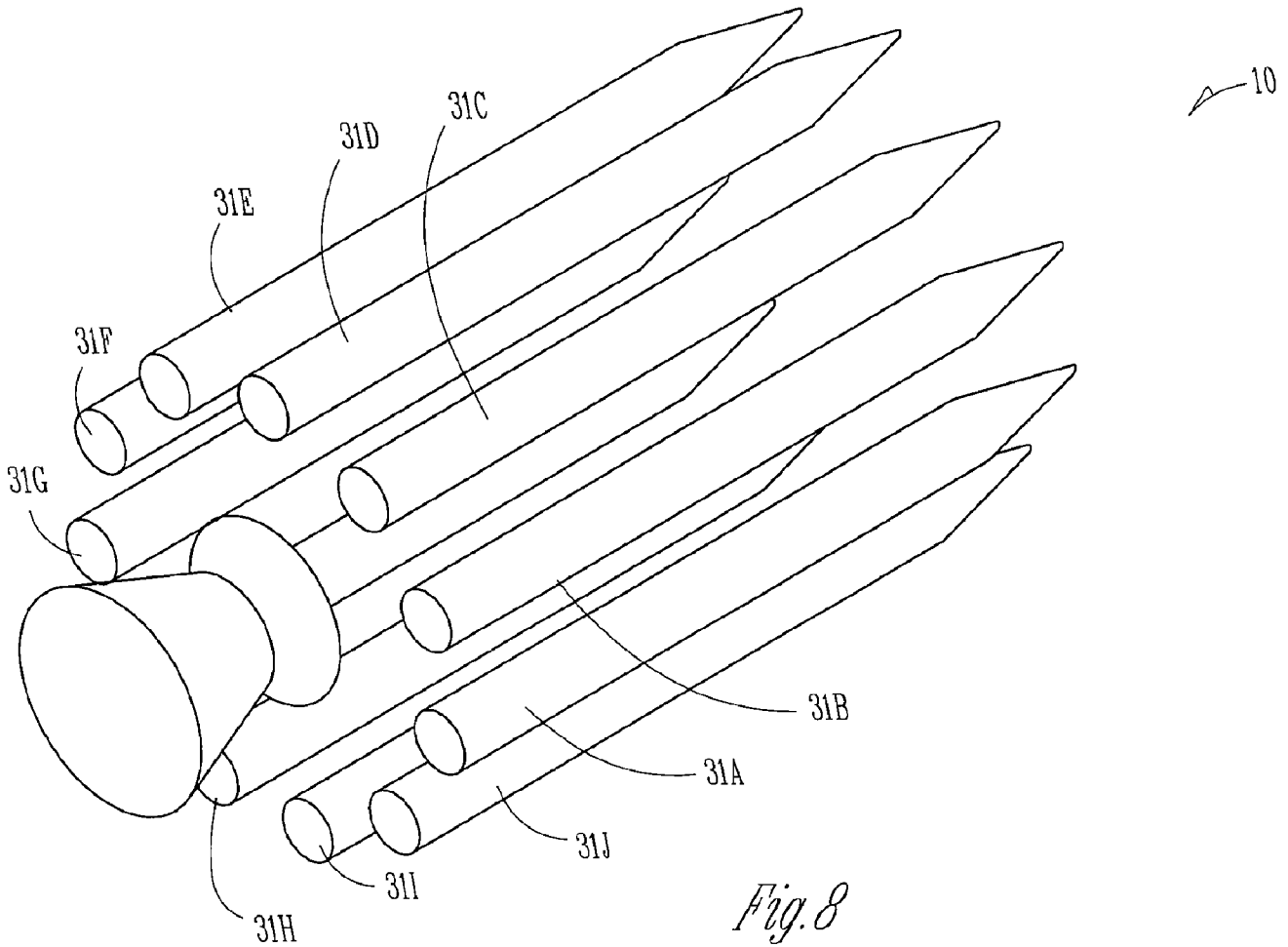
FIG. 8 illustrates the projectile of FIGS. 5-7 just after the ordinance in the projectile has exploded.

FIG. 8 shows how the flechettes 31A-J may disperse into a cylindrical arrangement after detonation of the explosive 51. This dispersion of the flechettes 31A-J may also cost effectively (i) increase the impact energy that can be generated by the projectile 10; and/or (ii) increase the size of the kill zone impacted by the projectile 10.

Figure 9:
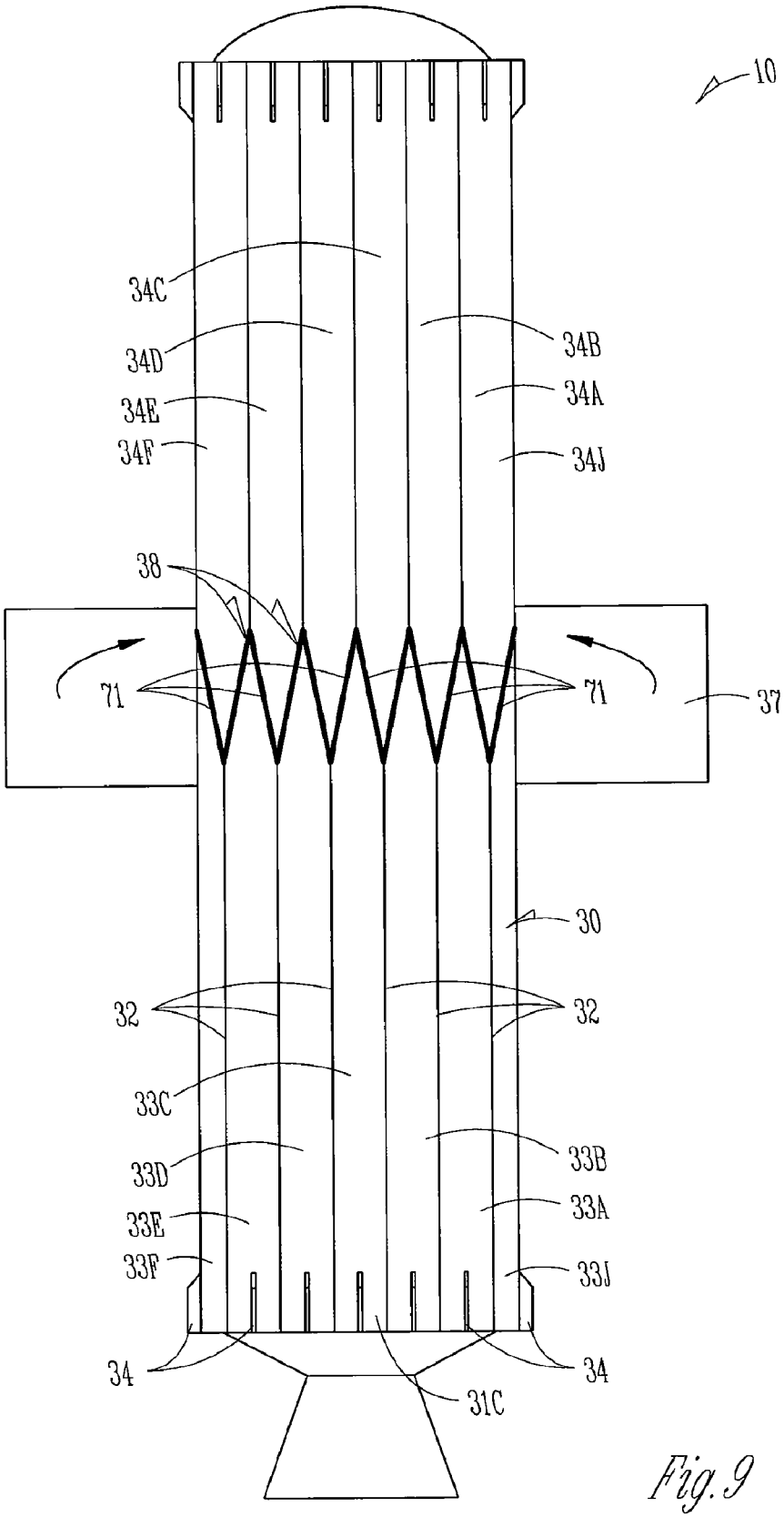
FIG. 9 is a side view of still another example projectile.

FIG. 9 illustrates an example embodiment of the projectile 10 where the sidewall of the casing 30 is formed of two sets of flechettes 33A-J, 34A-J. In some embodiments, an explosive 71 may be placed between the respective first and second sets of flechettes 33A-J, 34A-J such that the explosive 71 separates the respective sets of flechettes 33A-J, 34A-J upon detonation of the explosive 71.

The explosion will disperse of the flechettes 33A-J, 34A-J thereby increasing the size of the kill zone impacted by the projectile 10. It should be noted that even though the respective first and second sets of flechettes 33A-J, 34A-J are shown in opposing directions, the relative size, orientation and arrangement of the of the flechettes 33A-J, 34A-J may vary depending on the application where the projectile 10 is to be used.

In the example embodiment shown in FIG. 9, the projectile 10 further includes a member 37 that is wrapped about the casing 30 to support the casing 30 at the portion 38 of the casing 30 that is between the respective first and second sets of flechettes 33A-J, 34A-J. The size and type of member 37 that is used to support the casing 30 will depend in part on (i) the amount of support that may be required for the casing 30; (ii) the shape of the portion 38 requiring support; and (iii) the overall design of the rest of the projectile 10 (among other factors).

As shown in FIGS. 3 and 9-12, some (or all) of the flechettes 31A-J on the projectile 10 may include fins 34. The size, shape, orientation and location of the fins 34 will vary depending on design considerations associated with fabricating the projectile 10 and/or the intended use of the projectile 10.

Figure 10:
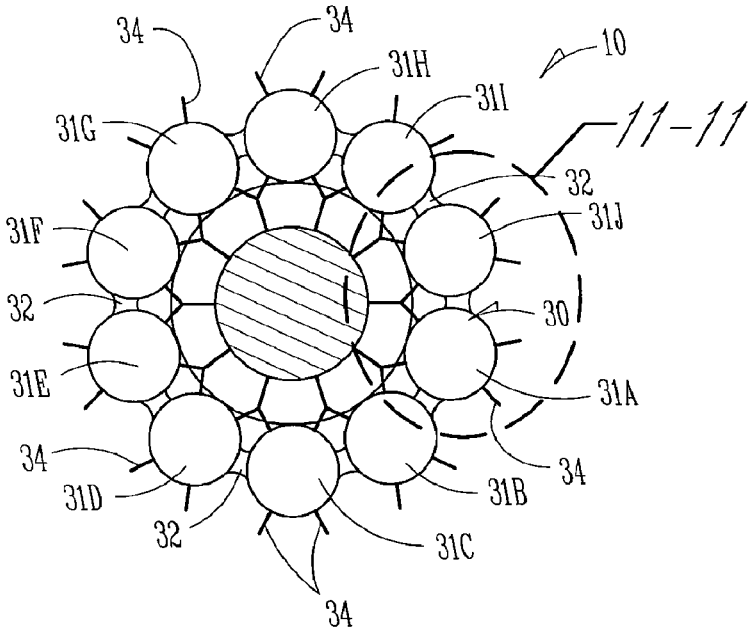
FIG. 10 is a bottom perspective view of another example projectile.
Figure 11:
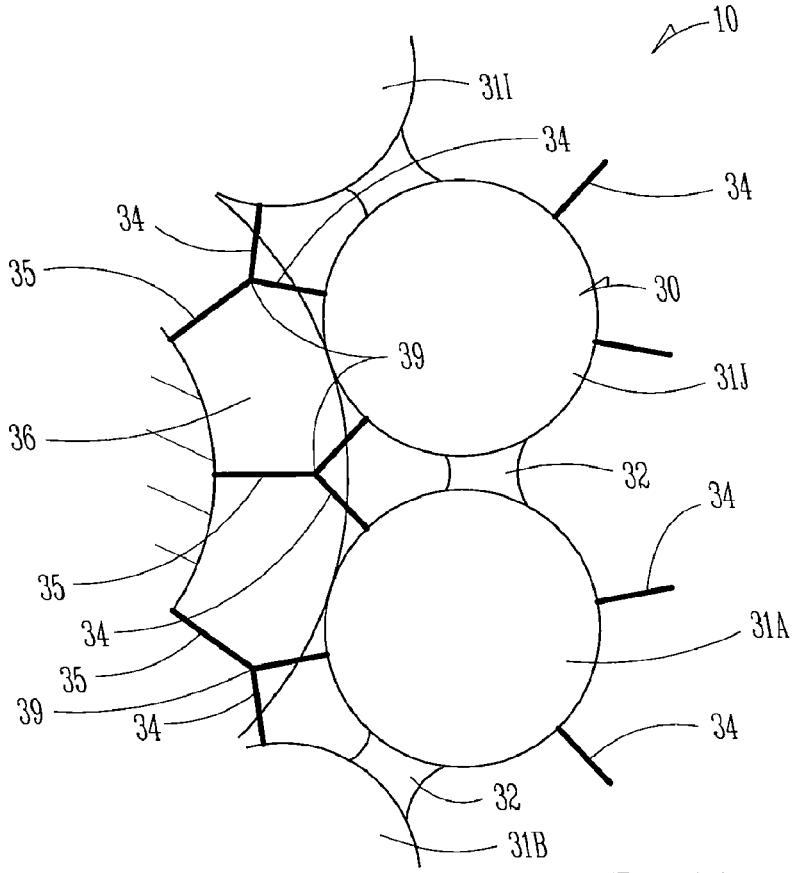
FIG. 11 is an enlarged perspective view of the projectile shown in FIG. 10 taken from the portion 11-11 in FIG. 10.

In the example embodiment illustrated in FIGS. 10 and 11, the fins 34 are part of a reinforcing web 35 that forms part of the nozzle 36 at the bottom end of the projectile 10 (e.g., the nozzle of the projectile 10). As shown in FIG. 11, the web 35 may include relatively thin portions 39 at the junctions where the fins 34 meet the rest of the web 35. The thin portions 39 form shear planes that induce the web 35 to fracture at the thin portions 39 thereby releasing the flechettes 31A-J from the rest of projectile 10.

Figure 12:
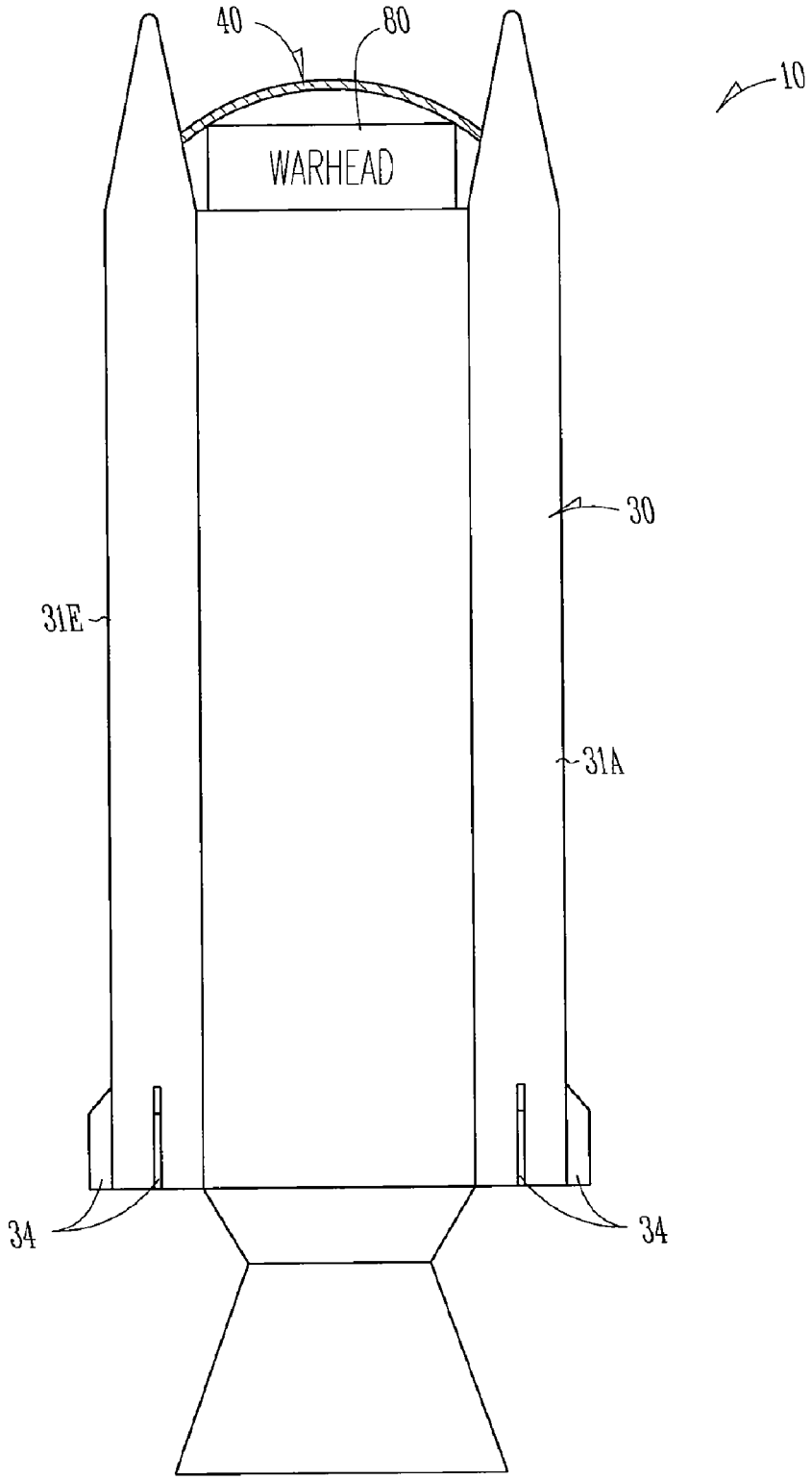
FIG. 12 is a schematic side section view of yet another example projectile where the projectile includes a warhead.

FIG. 12 is a schematic side partial section view illustrating another example embodiment of the projectile 10. In the example embodiment shown in FIG. 12, the projectile 10 includes a warhead 80. It should be noted that while FIG. 12 shows the warhead 80 as being in the dome 40 of projectile 10, the warhead 80 may be located anywhere in/on the projectile 10.

Figure 13:
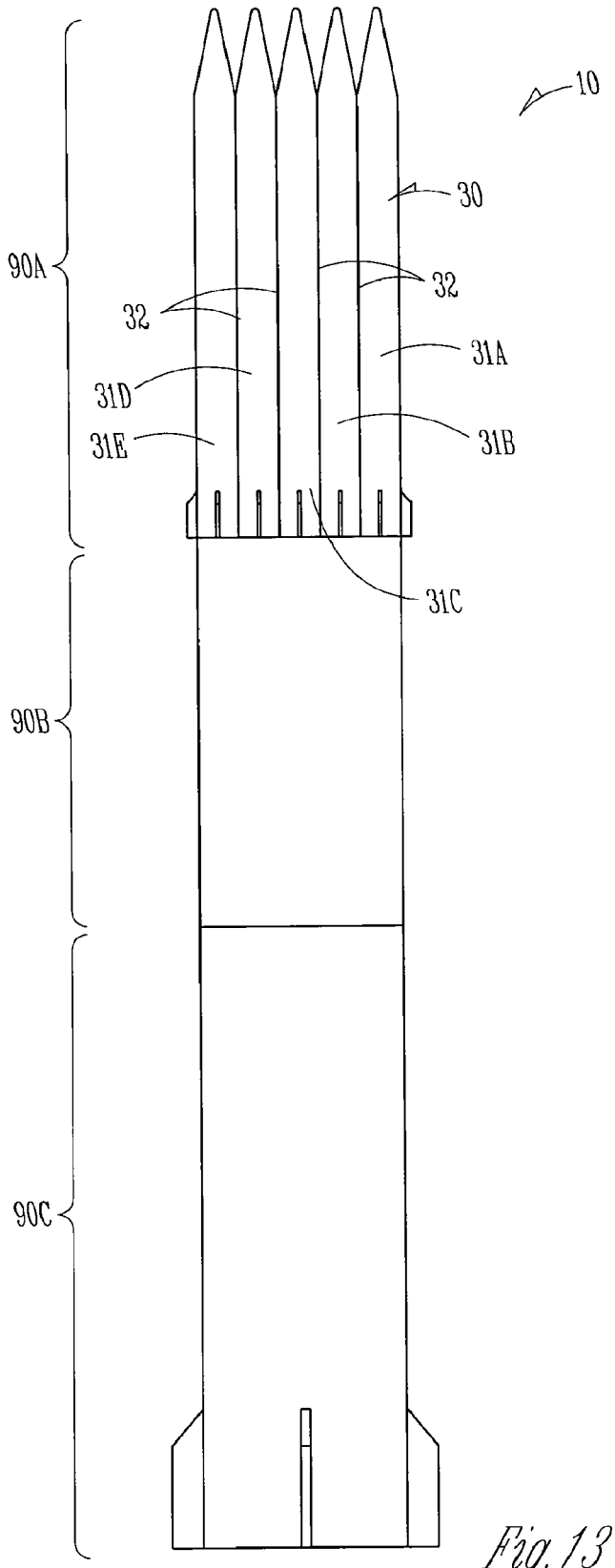
FIG. 13 illustrates an example embodiment of a projectile where the projectile is a rocket that includes multiple propulsion stages.

FIG. 13 illustrates an example embodiment where the projectile 10 is a rocket that includes multiple propulsion stages 90A, 90B, 90C and the casing 30 is part of one or more of the propulsion stages 90A, 90B, 90C of the rocket (propulsion stage 90A includes the casing 30 in the projectile 10 shown in FIG. 13). It should be noted that in other embodiments, the other stages 90A, 90B, 90C may include the casing 30.

The projectiles described herein may provide the ability to somewhat integrate a kinetic warhead into a projectile casing thereby allowing the mass of the warhead to be utilized in strengthening the projectile casing. The projectile casing includes a plurality of flechettes that serve as reinforcement beams which increase the structural rigidity of the projectile. The improved structural rigidity may (i) allow for the projectile to operate at a higher pressure; (ii) allow for an increase in the aspect ratio of the projectile; (iii) permit greater heat absorption capacity by the projectile casing; (iv) move the center of gravity of the missile aftward; and/or (v) reduce the quality control requirements associated with fabricating the projectile.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A projectile comprising:

a propellant;

a casing that is projected forward by the propellant, the casing encloses the propellant such that the casing acts as a reaction chamber during burn of the projectile, the casing including a plurality of flechettes that form a lateral outer sidewall of the casing such that the plurality of flechettes form an exterior surface of the casing.

2. The projectile of claim 1 wherein the propellant is a solid.

3. The projectile of claim 1 wherein the flechettes extend along an entire length of the exterior surface of the casing.

4. The projectile of claim 1 wherein at least some of the flechettes are part of a first set of flechettes and remaining flechettes are part of a second set of flechettes.

5. The projectile of claim 4 wherein the first set of flechettes and the second set of flechettes are facing in opposite directions.

6. The projectile of claim 1 wherein a longitudinal axis of each flechette is parallel to a flight axis of the projectile.

7. The projectile of claim 1 further comprising an explosive between the flechettes such that the explosive separates the flechettes upon detonation.

8. The projectile of claim 1 wherein the casing includes a dome at a forward end of the projectile, and the projectile further comprises an explosive within the dome such that the explosive separates the flechettes upon detonation.

9. The projectile of claim 1 wherein the projectile further comprises a warhead.

10. The projectile of claim 1 wherein at least some of the flechettes includes fins.

11. A projectile comprising:

a propellant;

a casing that is projected forward by the propellant, the casing encloses the propellant such that the casing acts as a reaction chamber during burn of the projectile, the casing including a plurality of flechettes that form a lateral outer sidewall of the casing such that the plurality of flechettes that form an exterior surface of the casing, wherein a longitudinal axis of each flechette is parallel to a flight axis of the projectile;

an explosive between the flechettes such that the explosive separates the flechettes upon detonation of the explosive; and a warhead within the casing.

12. The projectile of claim 11 wherein at least some of the flechettes includes fins.

* * * * *